US006047624A

United States Patent [19]

Xie

[11] Patent Number: 6,047,624

[45] Date of Patent: Apr. 11, 2000

[54] GUIDE BAR GUIDE ASSEMBLY AND ASSOCIATED BAND SAW APPARATUS

[75] Inventor: Mark Mingjun Xie, Tipp City, Ohio

[73] Assignee: Premark FEG L.L.C., Wilmington, Del.

[21] Appl. No.: 09/141,087

[22] Filed: Aug. 27, 1998

[51] Int. Cl.[7] ..... B26D 1/54

[52] U.S. Cl. ..... 83/820; 83/546; 83/829

[58] Field of Search ..... 83/820, 813, 814, 83/827, 829, 546, 860

[56] References Cited

U.S. PATENT DOCUMENTS

| | | | |
|---|---|---|---|
| D. 277,822 | 3/1985 | Doggett | D7/385 |
| 403,172 | 5/1889 | Backer | 83/820 X |
| 778,991 | 1/1905 | McDonough | 83/820 X |
| 799,150 | 9/1905 | Dittbenner | 83/820 |
| 1,054,288 | 2/1913 | Fleming | 83/814 |
| 1,811,906 | 6/1931 | Andre | 83/814 |
| 1,841,939 | 1/1932 | Koning et al. | 83/814 |
| 1,848,300 | 3/1932 | Avilla | 83/814 |
| 2,059,595 | 11/1936 | McKeage | 83/820 |
| 2,193,946 | 3/1940 | Tautz | 83/820 |
| 2,371,731 | 3/1945 | Boice et al. | 83/820 |
| 2,492,824 | 12/1949 | Ahrndt et al. | 83/860 |
| 2,525,004 | 10/1950 | Spang | 83/168 X |
| 2,884,026 | 4/1959 | Krenzke | 83/860 X |
| 3,104,575 | 9/1963 | Robinson | 83/820 |
| 3,104,688 | 9/1963 | Bretthauer | 83/441.1 |
| 3,285,301 | 11/1966 | McManama | 143/1 |
| 3,452,734 | 7/1969 | Cleland et al. | 125/21 |
| 3,680,421 | 8/1972 | Conner et al. | 83/201.14 |
| 3,682,030 | 8/1972 | Harris | 83/201.04 |
| 3,888,148 | 6/1975 | Weissman | 83/814 X |
| 3,889,564 | 6/1975 | Aspinwall et al. | 83/174 |
| 3,939,749 | 2/1976 | Muller et al. | 83/860 X |
| 4,290,330 | 9/1981 | Washio et al. | 83/820 |
| 4,327,621 | 5/1982 | Voorhees et al. | 83/820 |
| 4,640,170 | 2/1987 | Bakken | 83/794 |
| 5,588,213 | 12/1996 | Swanberg | 30/124 |
| 5,802,939 | 9/1998 | Wiand et al. | 83/820 |

OTHER PUBLICATIONS

Hobart Corporation "*Catalog of Replacement Parts Model 5801 Meat Saw*, " Oct. 1990.

*Primary Examiner*—Rinaldi I. Rada
*Assistant Examiner*—Dominic J Troiano
*Attorney, Agent, or Firm*—Thompson Hine & Flory LLP

[57] ABSTRACT

A guide assembly for receiving a guide bar of a band saw, includes a sleeve-shaped member having first and second ends. A first insert member is positioned within the sleeve-shaped member. An outer peripheral surface portion of the insert member forms a first guide bar receiving channel with an inner peripheral surface portion of the sleeve-shaped member. A second insert member may also be provided to form a second guide bar receiving channel which aligns with the first guide bar receiving channel. Said insert members may also include at least one exposed end having a peripheral lip which overlaps the respective end of the sleeve-shaped member.

18 Claims, 4 Drawing Sheets

GUIDE BAR GUIDE ASSEMBLY AND ASSOCIATED BAND SAW APPARATUS

FIELD OF THE INVENTION

The present invention relates to band saw guide assemblies and more particularly to a guide assembly for receiving a guide bar of a meat band saw wherein the guide bar is connected to a blade guard such that a position of the blade guard along a length of a band saw blade varies as a position of the guide bar relative to the guide assembly varies.

BACKGROUND OF THE INVENTION

In the food processing industry large upright band saws such as band saw 10 of FIG. 1 are commonly used for cutting meat products of a variety of sizes. Such band saws typically include a frame 12 upon which is mounted a support surface 14 for positioning meat products to be cut. A housing portion 16 extends above support surface 14 and a housing portion 18 extends below support surface 14. A band saw blade 20 passes though a plane defined by support surface 14 and extends around wheel members (not shown) located with housing portions 16 and 18 for being drivingly rotated by such wheel members. In particular, a drive motor 22 may be connected for rotating a drive wheel in housing portion 18. A blade guard 24 extends around the cutting edge of blade 20 and downward from housing portion 16 toward support surface 14. Blade guard 24 is connected to a guide bar 26 which extends upward toward housing portion 16 and through a guide assembly 28 which is mounted to housing portion 16. Guide bar 26 is slidably positioned within guide assembly 28 such that guide bar 26 can be moved upward or downward through such guide assembly if a sufficient moving force is applied thereto. However, with no moving force applied guide assembly 28 engages guide bar 26 with sufficient force to hold guide bar 26 and blade guard 24 in position. Because blade guard 24 is connected to guide bar 26 for movement therewith, the length of band saw blade 20 which is exposed above support surface 14 can be varied by varying the position of guide bar 26 relative to guide assembly 28. In this manner a variety of different sizes of meat products can be cut with band saw apparatus 10 without requiring exposure of a large length of blade 20 when cutting small meat products.

Referring to FIG. 2, an exploded perspective view of a prior art guide assembly 28 is shown relative to guide bar 26 and blade guard 24. Such guide assembly 28 includes a support member 30, a retaining plate 32, a brake shoe 34, a spring 36, a screw carrier 38, a screw 40 and an end cap 42. Support member 30 may be mounted to housing portion 16 by a bracket assembly 44 (shown in shadow) for example. Support member 30 includes channels 46, 48 through which guide bar 26 passes, with an open face 50 of support member 30 exposing a surface of guide bar 26. When assembled, retaining plate 32 is mounted to support member 30 by a plurality of screws (not shown), plate 32 including an opening 52 therethrough which extends to open face 50 of support member 30. Brake shoe 34, spring 36, screw carrier 38 and screw 40 are positioned withing opening 52 such that spring 36 urges brake shoe 34 into frictional contact with guide bar 26 to support guide bar 26 until the frictional force is overcome. As shown, blade guard 24 may be mounted to the bottom of guide bar 26 by a threaded handle 54.

Although effective, prior art guide assembly 28 is somewhat costly due to the machining requirements of support member 32. Further, guide assembly 28 can be difficult to clean when food material gets caught between retaining plate 32 and support member 30, adding to the time and expense of maintenance and cleaning of the band saw apparatus. Accordingly, it is desirable and advantageous to provide a guide assembly which is relatively simple, inexpensive, and less likely to undesirably trap food product.

In one aspect of the present invention, a guide assembly for receiving a guide bar of a band saw is provided, wherein the guide bar is connected to a blade guard such that a position of the blade guard along a length of a band saw blade varies as a position of the guide bar relative to the guide assembly varies. The guide assembly includes a sleeve-shaped member having first and second ends. A first insert member is positioned within the first end of the sleeve-shaped member such that an outer peripheral surface portion of the first insert member forms a first guide bar receiving channel with an inner peripheral surface portion of the first end of said sleeve-shaped member. A second insert member is positioned within the second end of the sleeve-shaped member such that an outer peripheral surface portion of the second insert member forms a second guide bar receiving channel with an inner peripheral surface portion of the second end of the sleeve-shaped member, with the second guide bar receiving channel being substantially aligned with said first guide bar receiving channel.

The guide bar may be slidably positioned through the aligned guide bar receiving channels. The use of a sleeve-shaped member with two insert members eliminates the costly machining associated with the prior art, particularly where the insert members are formed of a plastic material. Further, preferably each of the insert members includes an exposed end having a peripheral lip which overlaps its respective end of the sleeve-shaped member in a region extending from a first side of its respective guide bar receiving channel around the respective end to a second side of its respective guide bar receiving channel. Such peripheral lips facilitate proper positioning of the insert members in the respective ends of the sleeve-shaped member, and advantageously prevent food product from entering between the outer surfaces of the insert members and the inner surfaces of the ends of the sleeve-shaped member.

DETAILED DESCRIPTION OF THE EMBODIMENTS

Figure 3:
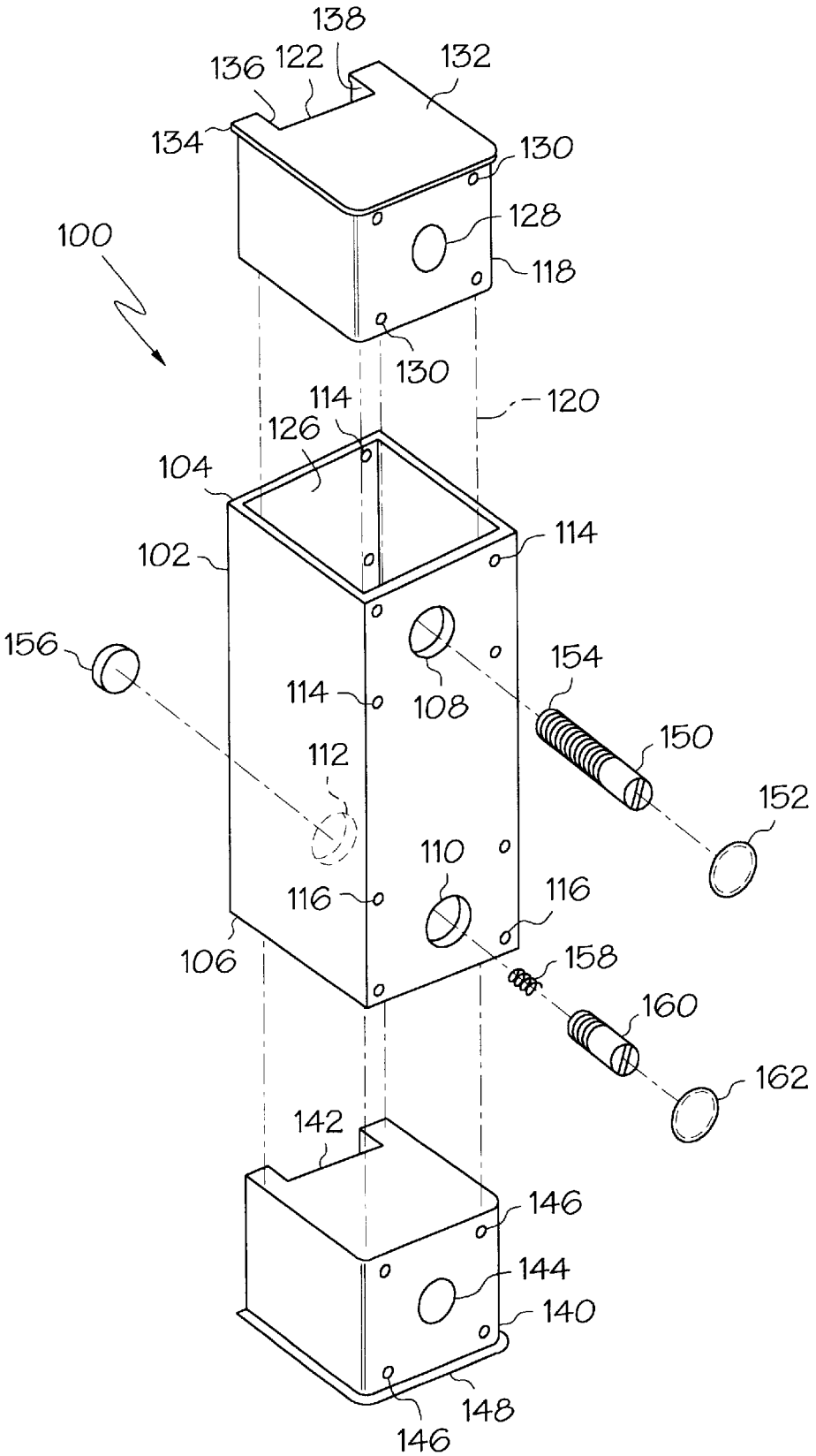
FIG. 3 is an exploded perspective view of a guide assembly in accordance with the present invention.

Referring to drawing FIG. 3, numeral 100 depicts an exploded view of a guide assembly in accordance with the present invention, such guide assembly 100 including a sleeve-shaped member 102 having open ends 104 and 106. Sleeve-shaped member 102 is preferably formed of a suitable metal and may advantageously be formed from a standard stock square tubing cut to length. Sleeve-shaped member 102 includes an opening 108 along a side portion thereof near end 104 and exposing the interior thereof. A similar opening 110 along a side portion thereof near end 106 exposes the interior thereof, and an opening 112 is aligned opposite opening 110. A plurality of smaller holes 114, 116 are provided in the region of each of openings 108, 110.

A block-shaped insert member 118 is configured to be positioned within end 104 sleeve-shaped member 102 as indicated by arrow 120. When so positioned, an outer peripheral surface portion 122 of insert member 118 forms a guide bar receiving channel 124 (FIG. 4) with an inner peripheral surface portion 126 of end 104 of sleeve-shaped member 102. In the preferred embodiment surface portion 122 is formed by an end-to-end recess formed in a side of insert member 118. Insert member 118 includes a through hole 128 and a plurality of smaller through holes 130 positioned such that when insert member 118 is inserted within end 104 of sleeve-shaped member 102 hole 128 aligns with hole 108, and holes 130 align with respective holes 114 for attachment purposes as described in greater detail below. Insert member 118 further includes an end 132 having an outer peripheral lip 134 extending beyond the sides thereof from a first side 136 of recess 122, around insert member 118, to a second side 138 of recess 122. When inserted, peripheral surface lip 134 contacts an end surface of end 104 to properly position insert member 118 and to provide sealing contact with end 104.

A similar insert member 140 is configured for positioning within end 106 of sleeve-shaped member 102 and includes an outer peripheral surface portion 142 formed by an end to end recess such that when inserted in end 106 a guide bar receiving channel is formed in alignment with the guide bar receiving channel 124 formed by insert member 118. Further, insert member 140 includes a through hole 144 and a plurality of smaller holes 146 configured 15. for alignment with sleeve-shaped member opening 110 and holes 116 respectively. An outer peripheral lip 148 is also provided on the exposed end of insert member 140.

In the preferred assembly, insert member 118 and insert member 140 may be formed identically to reduce manufacturing costs. Further, insert members 118, 140 may be formed from a high density polymeric material such as CELCON.

Also shown in the exploded view of FIG. 3 is a threaded member 150 for positioning through opening 108 of sleeve-shaped member 102 and hole 128 of insert member 118. In this regard, an internal portion of through hole 128 is threaded for receiving threaded member 150, which may for example be a set screw. An outer cap member 152 is configured for being fixed to opening 108 for covering the same. Threaded member 150 may be formed of any suitable material although end 154 of threaded member 150 will engage a surface of a guide bar inserted through assembly 100 and therefore at least such end 154 should be formed of a material such as plastic which will not cause excessive wear on the guide bar when slidingly contacting the same.

A brake shoe 156, a biasing member 158, a threaded member 160, and cap member 162 are likewise configured for positioning near end 106, with brake shoe 156 insertable through opening 112 and biasing member 158 and threaded member 160 insertable through opening 110 and hole 144. In this regard, as with hole 128, hole 144 of insert member 140 includes an inner threaded portion for receiving threaded member 160. Brake shoe 156 may be formed of a suitable rubber material for slidingly engaging a guide bar inserted into assembly 100. Biasing member 158 may be a compression spring but may likewise be any other suitable member which tends to exert a force when compressed, and threaded member 160 may likewise be formed of metal, plastic, or other material.

Figure 4:
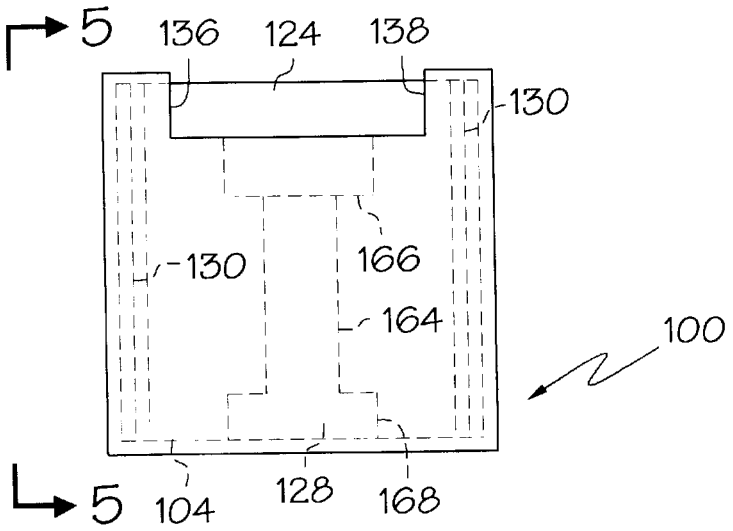
FIG. 4 is a top assembled view of the guide assembly of FIG. 3.

Referring now to FIG. 4 wherein a top view of guide assembly 100 is shown with insert members 118, 140 positioned within sleeve-shaped member 102, outer peripheral lip 134, 148 extend beyond ends 104, 106 of sleeve-shaped member 102 from side 136 of channel 124 to side 138 of channel 124. An inner threaded portion 164 of through hole 128, 144 is shown in shadow along with an open portion 166 in which brake shoe 156 may positioned for being biased into engagement with the guide bar. An open portion 168 of through hole 128, 144 in which an inner portion of respective cap member 152, 162 may be seated is also provided in each insert member 118, 140. Holes 130, 146 are also shown in shadow.

Figure 5:
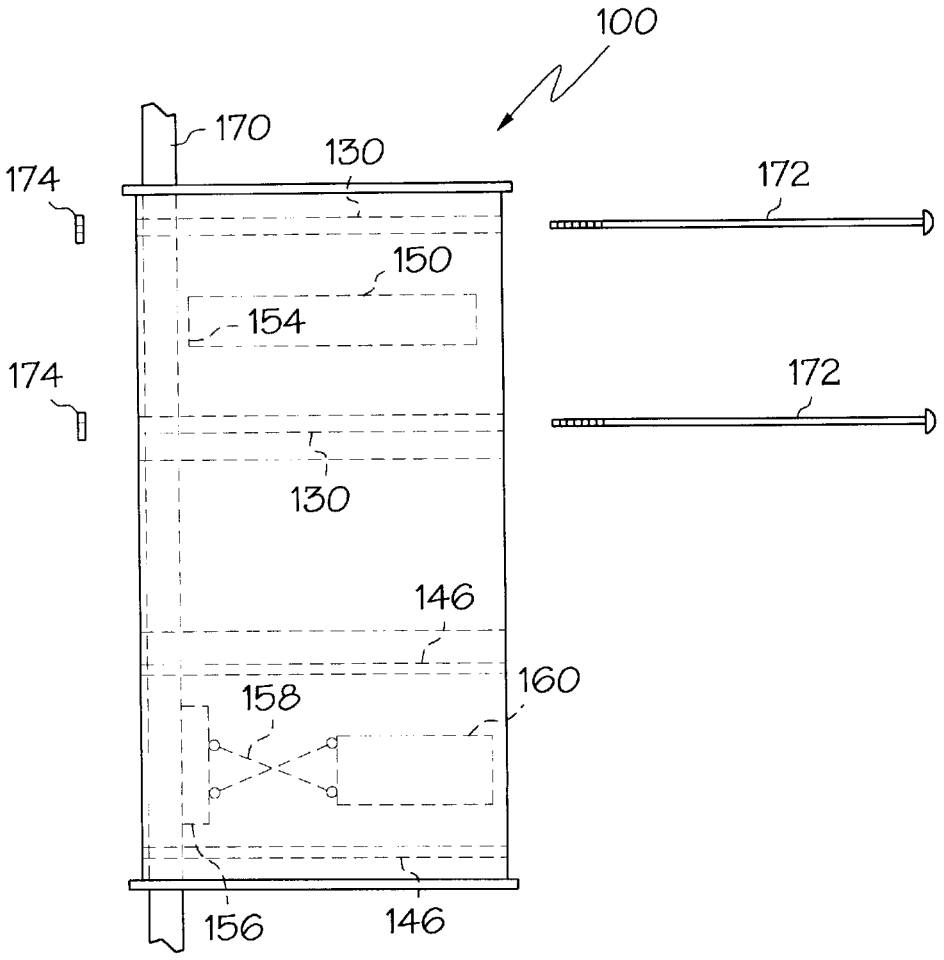
FIG. 5 is a side elevation view along line 5—5 of FIG. 4, including a guide bar inserted within the guide assembly.

As seen in the side elevation view of FIG. 5, a guide bar 170 may be positioned within guide assembly 100. Attachment bolts 172 and mating nuts 174 may be positioned through holes 130 for securing insert member 118 within sleeve-shaped member 100. Similar attachment bolts and nuts (not shown) may be used to secure insert member 140 within sleeve-shaped member 102 utilizing through holes 146. In operation threaded member 150 is tightened until the interior end 154 contacts the surface of guide bar 170 to prevent lateral (left-to right in FIG. 5) movement of guide bar 170. Threaded member 160 is tightened until its interior end engages biasing member 158, compressing biasing member 158 such that a force is exerted on brake pad 156 causing a brake surface of brake pad 156 to contact a surface of guide bar 170. Brake pad 156 engages guide bar 170 with sufficient force to hold guide bar 170 from moving in the downward direction unless an external force is applied to guide bar 170 to cause such movement. The external force required for upward or downward movement of guide bar 170 can be adjusted by adjusting the compression of biasing member 158 with threaded member 160.

Figure 1:
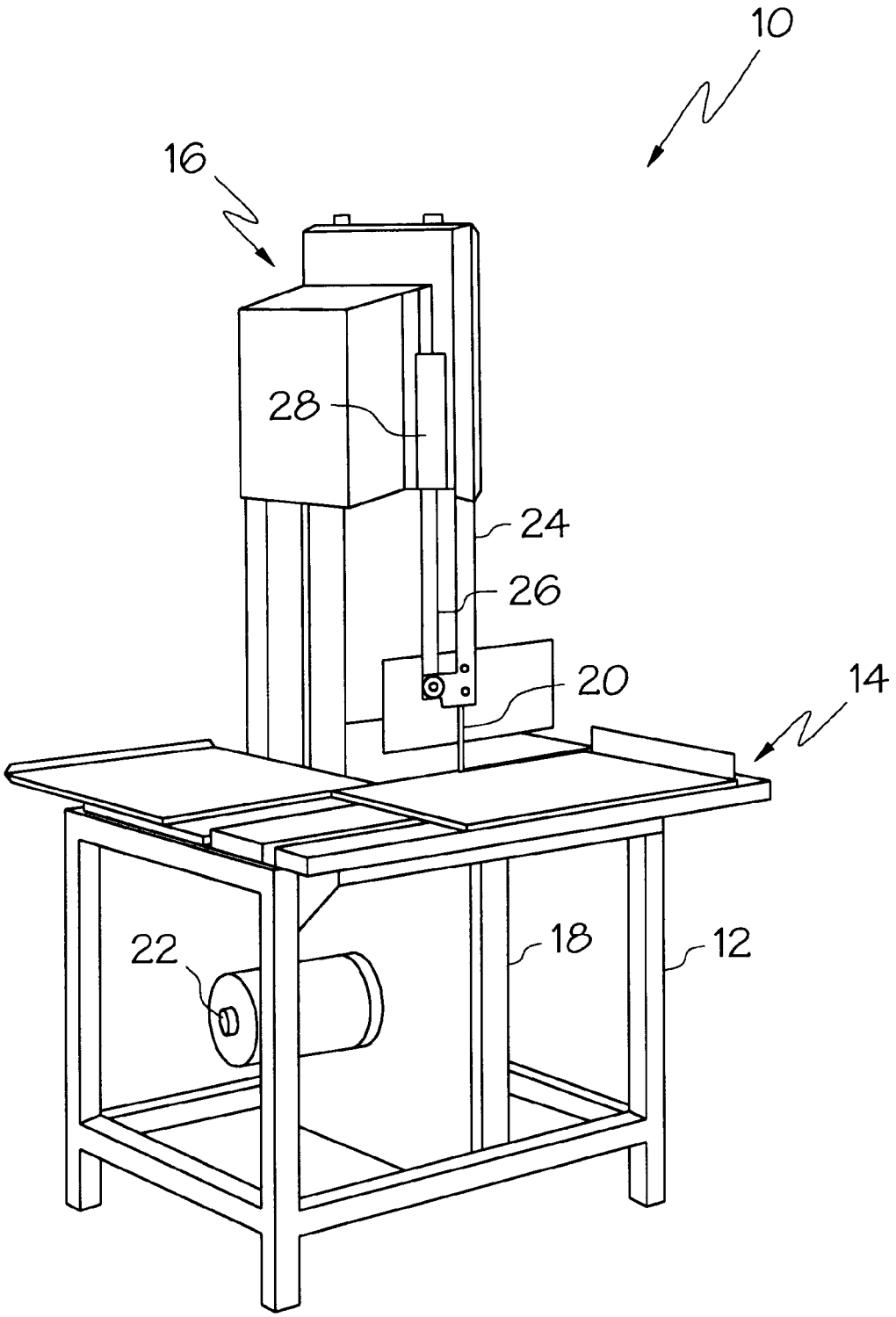
FIG. 1 PRIOR ART
FIG. 1 is a perspective view of a band saw apparatus.
Figure 2:
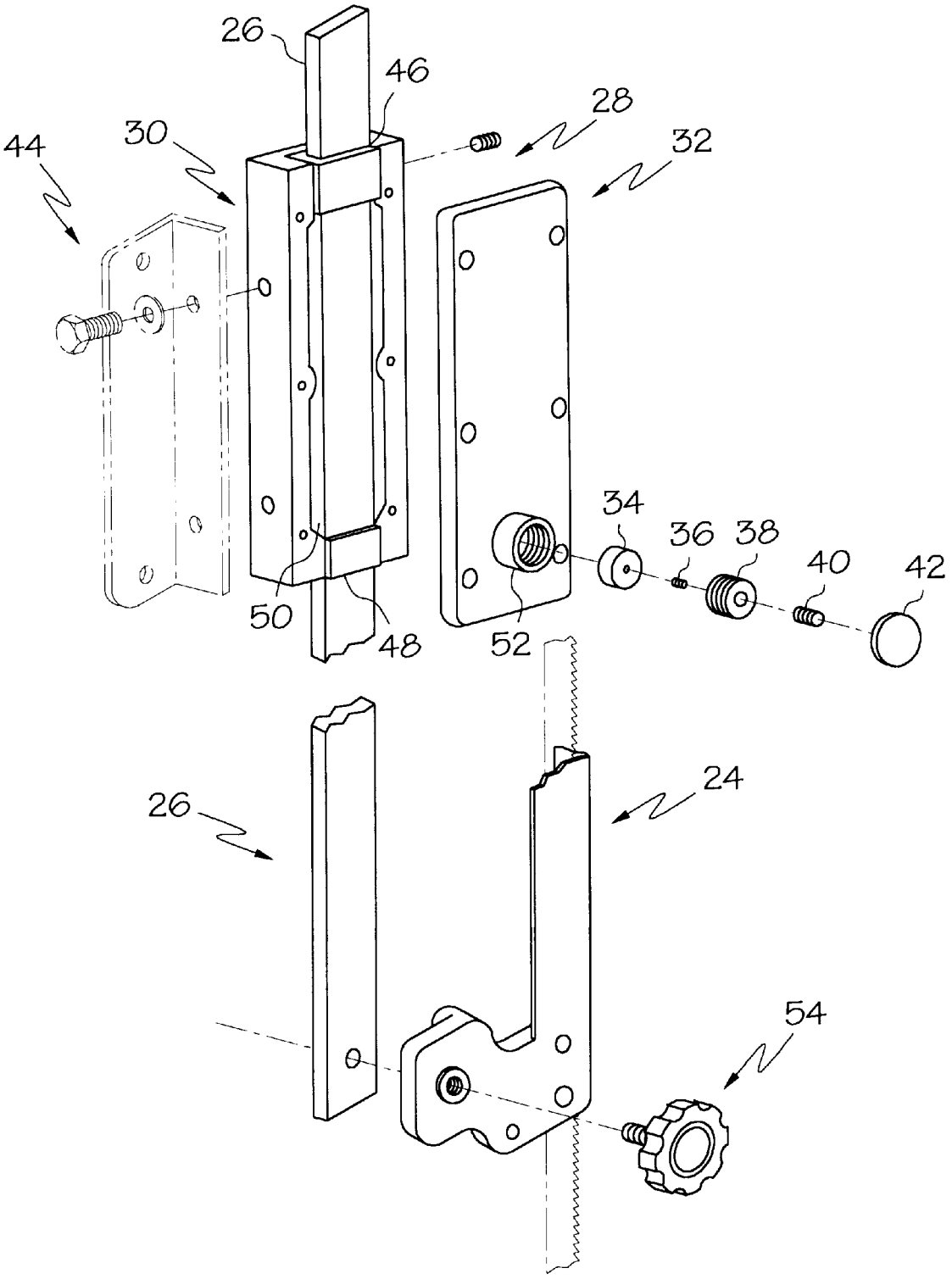
FIG. 2 PRIOR ART
FIG. 2 is an exploded perspective view of a prior art guide assembly and associated guide bar and blade guard.

Guide assembly 100 can be positioned in a band saw apparatus such as that shown in FIG. 1 with a blade guard 24 connected for movement with guide bar 170. Such attachment to a band saw apparatus may be by a bracket assembly as shown in FIG. 2 but advantageously may also be achieved by using the same bolt 172 and nut 174 assemblies used to secure insert members 118, 140 in position. The use of sleeve-shaped member 102 with insert members 118, 140 eliminates the costly machining associated with the prior art. Further, the peripheral lip of each insert member 118, 140 which overlaps its respective end 104, 106 facilitates proper positioning of the insert members 118, 140 in the respective ends of sleeve-shaped member 102, and advantageously prevents food product from entering between the outer surfaces of insert members 118, 140 and the inner surfaces of ends 104, 106 of sleeve-shaped member 102.

Although the invention has been described and illustrated in detail it is to be clearly understood that the same is intended by way of illustration and example only and is not intended to be taken by way of limitation. For example, although sleeve-shaped member 102 is shown as an elongated square tube it is recognized that sleeve-shaped member 102 could take some other shape with insert members 118, 140 being similarly shaped for insertion therein. Accordingly, the spirit and scope of the invention are to be limited only by the terms of the appended claims.

What is claimed is:

1. A guide assembly for receiving a guide bar of a band saw, the guide assembly comprising:

a sleeve-shaped member having first and second open ends which define an axial length of said sleeve-shaped member;

a first insert member positioned within said first open end of said sleeve-shaped member, an outer peripheral surface portion of said first insert member forming a first guide bar receiving channel with an inner peripheral surface portion of said first open end of said sleeve-shaped member; and a second insert member positioned within said second open end of said sleeve-shaped member, an outer peripheral surface portion of said second insert member forming a second guide bar receiving channel with an inner peripheral surface portion of said second open end of said sleeve-shaped member such that said second guide bar receiving channel is substantially aligned with said first guide bar receiving channel.

2. The guide assembly of claim 1 wherein said sleeve-shaped member includes a first opening along a side portion thereof, said first opening exposing a side portion of said first insert member, said first insert member including a through hole which extends from said side portion to said first guide bar receiving channel.

3. The guide assembly of claim 2 wherein at least a portion of said through hole of said first insert member is threaded, the guide assembly further comprising a first threaded member, a biasing member, and a brake shoe, said threaded member threaded within said through hole of said first insert member, said biasing member including a first side for positioning adjacent an internal end of said threaded member and a second side for positioning adjacent said brake shoe, said brake shoe including a brake surface for engaging a surface of the guide bar when the guide bar is positioned within said first guide bar receiving channel.

4. The guide assembly of claim 3 wherein said sleeve-shaped member includes a second opening along a side portion thereof, said second opening exposing a side portion of said second insert member, said second insert member including a through hole which extends from said side portion to said second guide bar receiving channel, at least a portion of said through hole of said second insert member being threaded, the guide assembly further comprising a second threaded member threaded within said through hole of said second insert member.

5. The guide assembly of claim 1 wherein said first insert member includes an exposed end having a peripheral lip which overlaps said first open end of said sleeve-shaped member in a region extending from a first side of said first guide bar receiving channel around said first open end to a second side of said first guide bar receiving channel, and wherein said second insert member includes an exposed end having a peripheral lip which overlaps said second open end of said sleeve-shaped member in a region extending from a first side of said second guide bar receiving channel around said second open end to a second side of said second guide bar receiving channel.

6. The guide assembly of claim 1 wherein each of said first and second insert members is secured within its respective open end by at least one respective threaded member.

7. The guide assembly of claim 1 wherein said sleeve-shaped member is substantially rectangular in cross-section along its length and each of said first and second insert members is substantially block-shaped, wherein said first insert member includes a side having an end-to-end recess formed therein which recess is defined by said outer peripheral surface portion which forms said first guide bar receiving channel, and wherein said second insert member includes a side having an end-to-end recess formed therein which recess is defined by said outer peripheral surface portion which forms said second guide bar receiving channel.

8. The guide assembly of claim 1 wherein said sleeve-shaped member is formed from a metal material and wherein each of said first and second insert members is formed of a plastic material.

9. A band saw apparatus for cutting meat comprising:

a support surface for positioning an item to be cut thereon;

a housing portion extending above said support surface;

a blade extending through a plane defined by said support surface;

a guide assembly including a sleeve-shaped member mounted to said frame and having first and second ends, a first insert member positioned within said first end such that an outer peripheral surface portion of said first insert member forms a first channel with an inner peripheral surface portion of said first end, a second insert member positioned within said second end such that an outer peripheral surface portion of said second insert member forms a second channel with an inner peripheral surface portion of said second end, wherein said second channel is substantially aligned with said first channel;

a guide bar extending through said first and second channels of said guide assembly toward said support surface; and a blade guard connected to said guide bar for movement therewith.

10. The band saw apparatus of claim 9 wherein said guide assembly includes a brake shoe having a brake surface engaging a surface of said guide bar, said brake shoe positioned within an opening of said first insert member and being biased into engagement with said guide bar by a biasing member.

11. The band saw apparatus of claim 10 wherein said sleeve-shaped member of said guide assembly includes a first opening along a side portion thereof and adjacent a side portion of said first insert member, said first insert member including a through hole which extends from said first opening of said sleeve-shaped member toward said biasing member and said brake shoe, a threaded member threaded into said through hole such that an end thereof engages said biasing member for providing adjustment of a biasing force of said biasing member.

12. The band saw apparatus of claim 11 wherein said sleeve-shaped member of said guide assembly includes a second opening along a side portion thereof and adjacent a side portion of said second insert member, said second insert member including a through hole which extends from said second opening of said sleeve-shaped member to said second channel, a threaded member being threaded into said through hole of said second member such that an interior end thereof engages a surface portion of said guide bar.

13. The band saw apparatus of claim 9 wherein said first insert member includes an exposed end having a peripheral lip which overlaps said first end of said sleeve-shaped member in a region extending from a first side of said first channel around said first end to a second side of said first channel, and wherein said second insert member includes an exposed end having a peripheral lip which overlaps said second end of said sleeve-shaped member in a region extending from a first side of said second channel around said second end to a second side of said second channel.

14. The band saw apparatus of claim 9 wherein said sleeve-shaped member is substantially rectangular in cross-section along its length and each of said first and second insert members is substantially block-shaped, wherein said first insert member includes a side having an end-to-end recess formed therein which recess is defined by said outer peripheral surface portion which forms said first channel, and wherein said second insert member includes a side having an end-to-end recess formed therein which recess is defined by said outer peripheral surface portion which forms said second channel.

15. A guide assembly for a band saw having a guide bar and blade guard, said guide assembly, comprising:

a sleeve-shaped member having first and second ends;

at least one insert member positioned within said sleeve-shaped member, an outer peripheral surface portion of said insert member forming a guide bar receiving channel with an inner peripheral surface portion of said sleeve-shaped member, said insert member including at least one exposed end having a peripheral lip which overlaps one of said ends of said sleeve-shaped member in a region extending from a first side of said guide bar receiving channel around said sleeve-shaped member end to a second side of said guide bar receiving channel;

said guide bar positioned through said guide bar receiving channel; and said blade guard connected to said guide bar for movement therewith.

16. The guide assembly of claim 15 wherein said guide assembly further includes a brake pad and a biasing member positioned between said insert member and said guide bar, said biasing member biasing said brake pad into engagement with said guide bar to resist movement of said guide bar within said channel.

17. The guide assembly of claim 16 wherein said sleeve-shaped member includes a first opening along a side portion thereof and adjacent a side portion of said insert member, said insert member including a through hole which extends from said first opening of said sleeve-shaped member toward said biasing member, a threaded member being threaded within said through hole such that an end thereof engages said biasing member for providing adjustment of a biasing force exerted by said biasing member against said brake pad.

18. The guide assembly of claim 15 wherein said insert member is formed from a high density polymeric material.

* * * * *